US010441488B2

(12) United States Patent
Mitchell

(10) Patent No.: US 10,441,488 B2
(45) **Date of Patent: *Oct. 15, 2019**

(54) CAREGIVER'S HELPER LIFT

(71) Applicant: Dawn Hideko Mitchell, Arvada, CO (US)

(72) Inventor: Dawn Hideko Mitchell, Arvada, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/937,852

(22) Filed: Mar. 27, 2018

(65) Prior Publication Data

US 2018/0214329 A1 Aug. 2, 2018

Related U.S. Application Data

(63) Continuation-in-part of application No. 14/658,141, filed on Mar. 14, 2015, now Pat. No. 9,925,106.

(51) Int. Cl.
*A61G 7/10* (2006.01)

(52) U.S. Cl.
CPC ..... *A61G 7/1073* (2013.01); *A61G 7/1015* (2013.01); *A61G 7/1036* (2013.01); *A61G 7/1046* (2013.01); *A61G 7/1051* (2013.01); *A61G 7/1074* (2013.01)

(58) Field of Classification Search
CPC ..... A61G 7/10; A61G 7/1013; A61G 7/1015; A61G 7/1017; A61G 7/1051; A61G 7/1046; A61G 7/109; A61G 7/1067; A61G 7/1001; A61G 7/1019; A61G 7/1023; A61G 7/1025; A61G 7/1026; A61G 7/1044; A61G 7/1049; A61G 7/1053; A61G 7/1055; A61G 7/1057; A61G 7/1059; A61G 7/1073; A61G 7/1074; A61G 7/1036; A62B 35/0043; A62B 35/0075; A62B 35/005; A62B 35/0056; A62B 35/0068
See application file for complete search history.

(56) References Cited

U.S. PATENT DOCUMENTS 4,090,625 A * 5/1978 Walters ..... B66C 23/48 212/264
4,484,366 A * 11/1984 Koontz ..... A61G 7/1015 212/273
5,569,129 A * 10/1996 Seif-Naraghi ..... A61G 7/1019 135/67
2005/0039256 A1* 2/2005 Price ..... A61G 7/1011 5/86.1

(Continued)

*Primary Examiner* — Nicholas F Polito
*Assistant Examiner* — Amanda L Bailey

(57) ABSTRACT

A caregiver's helper lift utilizes a unique hoisting apparatus, a lifting harness worn by a patient, and a control apparatus to allow a caregiver to raise and lower a patient into/out-of a wheelchair and into/out-of a vehicle, down to or up off a floor, or to any other position/location that a patient needs to be moved. The lifting harness can clip to a lift attachment which is affixed to a helper lift suspension cable/rope/etc. The caregiver's helper lift utilizes a crane arm to suspend the patient and allow him or her to be repositioned by simply rolling/turning the lift. By actuating the hoisting apparatus control system, the patient can be controllably raised and lowered as desired. The crane arm can be adjustably attached to a power T upright which is itself attached to a brace base. At least two beam extensions extend laterally from the brace and provide stability.

20 Claims, 15 Drawing Sheets

(56) References Cited

U.S. PATENT DOCUMENTS

| | | | | |
|---|---|---|---|---|
| 2008/0229495 | A1* | 9/2008 | Takizawa | A61G 7/1019 5/86.1 |
| 2011/0016628 | A1* | 1/2011 | Masterson, Jr. | A61G 7/1015 5/87.1 |
| 2013/0126269 | A1* | 5/2013 | Perner | A62B 35/0068 182/9 |
| 2013/0318708 | A1* | 12/2013 | Wang | A61G 7/1003 5/87.1 |

* cited by examiner

CAREGIVER'S HELPER LIFT

CROSS-REFERENCE TO RELATED APPLICATIONS

This application claims the benefit of U.S. application Ser. No. 14/658,141 and filed on Mar. 14, 2015 which is specifically incorporated by reference herein for all that it discloses and teaches.

TECHNICAL FIELD

The present invention relates generally to the field of health care and mobility, and more particularly to a caregiver's helper lift to assist in lifting, moving, and/or repositioning a person.

BACKGROUND

As our population continues to see a shift towards an ever higher average age, more and more people are living into their later years when their mobility may be impaired and they need assistance to get around. And it's not just the elderly that can find themselves in such a position—sports injuries, accidents, various diseases, and other causes can result in a person needing to utilize a wheelchair or similar conveyance to get around (hereinafter, "wheelchair" is defined to include all such devices that assist mobility-impaired individuals in moving about). Regardless of the reason, it can be difficult for a mobility-impaired person (hereinafter, "patient", for ease of reference) to transfer themselves out of a wheelchair and into a vehicle or vice-versa. Additionally, getting in and out of a bath, hot tub, or other similar situations can also be difficult for a patient to do by themselves. Therefore, many patients rely on their friends and family to act as caregivers to provide assistance in such situations.

However, it can be extremely difficult for one person to safely transfer a patient in some (or all) of the situations described above. This is especially true when the caregiver is significantly smaller than the patient, is elderly or otherwise infirm himself/herself, etc. In such cases, caregivers and their patients can find themselves either consciously or unconsciously becoming shut-ins or otherwise avoiding the dangerous situations when the caregiver must assist the patient in effecting a transfer.

What is needed is a caregiver's helper lift that can assist a caregiver (or even a patient acting alone) in safely and efficiently moving or transferring a patient into and out of a wheelchair/vehicle/bathtub/toilet/etc. A caregiver's helper lift can be used in many transfer situations, but one of the areas in which it is most needed is in assisting patients out of their wheelchairs and into an automobile or similar vehicle (as well as transferring them out of the vehicle and back into their wheelchair). Although the prior art has attempted to address this need, the resulting assistance devices have fallen short of providing complete solutions to the problem. One common shortfall is that some devices are not portable and instead must stay in the garage or home-area of the patient. Such devices can help somewhat in transferring a patient into a vehicle, but are no help once the vehicle arrives at its destination. Other devices attempt to be portable, but caregivers can find that trying to break-down, fold-up or otherwise wrangle the device into a vehicle's trunk or backseat can be more difficult than manually transferring the patient without an assistance device. Therefore, what is needed is a caregiver's helper lift that can assist a caregiver in transferring a patient into or out of a wheelchair, is light enough to be easily portable, and is small enough to be stowed in a trunk or backseat so it can be brought along in a vehicle and used as needed. Additionally, what is needed is an additional component which helps the caregiver or patient pull the patient into the correct position over the car seat or other location to which the patient is being moved.

BRIEF DESCRIPTION OF THE DRAWINGS

The aforementioned and other features and objects of embodiments and manners of attaining them will become more apparent and embodiments will be best understood by reference to the following descriptions of a preferred embodiment and other embodiments taken in conjunction with the accompanying drawings, wherein.

DETAILED DESCRIPTION

Figure 1:
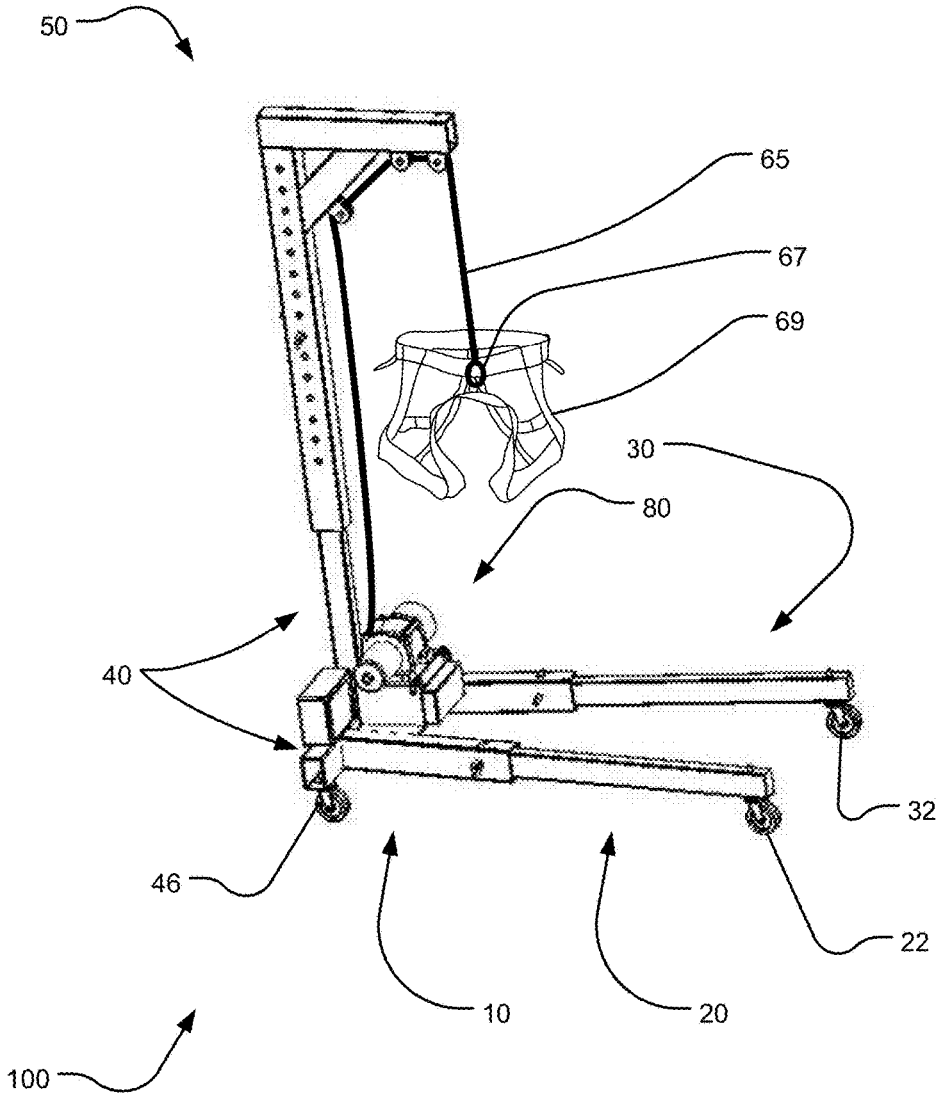
FIG. 1 illustrates a right side perspective view of an exemplary embodiment of a caregiver's helper lift shown attached to an exemplary lifting harness.

In the following discussion, numerous specific details are set forth to provide a thorough understanding of the present disclosure. However, those skilled in the art will appreciate that embodiments may be practiced without such specific details. Furthermore, lists and/or examples are often provided and should be interpreted as exemplary only and in no way limiting embodiments to only those examples.

Exemplary embodiments are described below in the accompanying Figures. The following detailed description provides a comprehensive review of the drawing Figures in order to provide a thorough understanding of, and an enabling description for, these embodiments. One having ordinary skill in the art will understand that in some cases well-known structures and functions have not been shown or described in detail to avoid unnecessarily obscuring the description of the embodiments.

Referring now to the drawings, FIG. 1 illustrates a right side perspective view of an exemplary embodiment of a caregiver's helper lift 100 shown attached to an exemplary lifting harness 69. In order to utilize the lift 100, a patient simply wears a lifting harness 69 and clips-in to the lift 100 by attaching the removable lift attachment 67 to the lifting harness 69. The lift attachment 67 is affixed (may be removable affixed) to the helper lift suspension 65. The helper lift suspension 65 can be rope, cable, or any other suitably strong and relatively thin rope-like material that can safely and securely support the weight of the patient. In one embodiment, climbing rope is used. In another embodiment, coated cable is used. Once the patient has clipped-in by attaching the removable lift attachment 67 to the lifting harness 69, the caregiver's helper lift 100 can be actuated to reel-in the helper lift suspension 65 and lift the patient from the wheelchair. In another embodiment, the lift 100 can be used to lift a patient from the floor/ground. In yet another embodiment, the lift 100 can be used to lift a patient from a vehicle, etc.

The lift 100 is actuated by engaging the power plant 80. In the embodiment shown in FIG. 1, the power plant 80 comprises a hoist apparatus that draws in or plays out, as needed, the helper lift suspension 65 to raise or lower the patient. In another embodiment, a manual hand-cranked hoisting apparatus can be used instead. In yet another embodiment, other types of power plants 80 are contemplated. For example, a two-way winch can be used.

The lift 100 employs a crane arm 50 in the embodiment illustrated in FIG. 1. The crane arm 50 extends outwards beyond the power plant 80, allowing the lift 100 to be used without having to place the patient directly on top of the power plant 80. The longer the horizontal component of the crane arm 50, the further from the power plant the patient can be located. However, the further back the patient is, the more strain is placed on the lift 100 and so the patient should be placed as close to the power plant 80 as possible. The crane arm 50 illustrated in FIG. 1 is adjustable in height by actuating the unlocking mechanism and sliding the crane arm 50 up or down relative to the power T upright 40. The crane arm 50 should be adjusted to favor lower positions as this reduces the strain on the lift 100 and limits complications. Once the proper position is selected, the user should lock the crane arm 50 in place relative to the power T upright 40.

In the embodiment illustrated in FIG. 1, an upright portion of the power T upright 40 comprises a vertical member that is adapted to slide within a tubular structure that comprises a lower portion of the crane arm 50. In another embodiment, the crane arm 50 can be the element that is adapted to slide within a tubular structure that comprises the upright portion of the power T upright 40. In yet other embodiments, the upright 40 and crane arm 50 can be configured to slide next to one another or otherwise be adjustable in position to one another without requiring that one slide within the other.

The power T upright 40 comprises a T shaped member wherein the T is inverted so that what is normally considered the cross-top member of the T is located below the upright portion of the T that interacts with the crane arm 50. See later drawing FIGs. for more details. In the embodiment illustrated in FIG. 1, the cross-top member of the power T upright 40 is attached to the brace base 10.

The brace base 10 provides a solid base for the lift 100. The brace base 10 can be the primary point of attachment for the main components of the lift 100, including the power T upright 40, the power plant 80, the first balance beam extension 20 and the second balance beam extension 30. As shown in the embodiment illustrated in FIG. 1, the brace base 10 is oriented as if the H was lying down, horizontally. What can be described as the tops of the vertical portions of a standard capital letter H, are, in the brace base 10, attached to the power T upright 40, while the bottoms of the letter H are attached to the first and second balance beam extensions 20 and 30. In the embodiment shown in FIG. 1, the horizontal cross member 11 (not labeled in FIG. 1, see FIG. 2) of the H is adapted to hold the power plant and associated items.

In one embodiment, the brace base 10 is fixedly attached to the power T upright 40. In another embodiment, the brace base 10 is removably attached to the power T upright 40. In either scenario, the connections between the components should be strongly built, as a large portion of the stresses is applied to these components during use of the lift 100. In yet another embodiment, the horizontal cross member 11 of the brace base 10 is not suspended between the uprights of the H; instead, horizontal cross member 11 is cantilevered off the other side of the power T upright 40 (opposite the side of the brace base 10 connected to the first and second balance beam extensions 20 and 30). See FIGS. 11, 12 and 13 for additional examples of such embodiments.

The first balance beam extension 20 extends from a proximal end outwards substantially horizontally from the bottom of the right H member of the brace base 10, while the second balance beam extension 30 extends from a proximal end outwards substantially horizontally from the bottom of the left H member of the brace base 10. As illustrated in the embodiment of FIG. 1, the first and second balance beam extensions 20 and 30 are adapted to slidably engage the bottoms of the brace base 10. In other embodiments, other means of connecting the extensions 20 and 30 to the brace base 10 are contemplated. The balance beam extensions 20 and 30 can be free-floating, as illustrated in FIG. 1. In another embodiment, they can be connected to one another to provide further stability and rigidity. For example, a cross-beam bar could attach in proximity to the distal ends of the beam extensions, a curved U bracket could attach to the two distal ends, etc.

In proximity to the distal ends of the extensions 20 and 30 can be mounted first and second balance beam extension wheels 22 and 32, respectively. The balance beam extension wheels 22 and 32 act in cooperation with those under the power T upright 40 (see T bar first wheel 46 in FIG. 1 and T bar second wheel 48 in FIG. 8) to allow the lift 100 to roll across a surface when desired. The plurality of wheels 22, 32, 46 and 48 can be lockable caster wheels that the user can selectively choose to be freely rotating or locked. In other embodiments, other types of wheels 22, 32, 46 and 48 (such as non-lockable caster wheels, studded wheels, no-mar wheels, etc.) are contemplated. In yet another embodiment, it is contemplated that the number of wheels can be zero, one, two, three or five or more.

Figure 2:
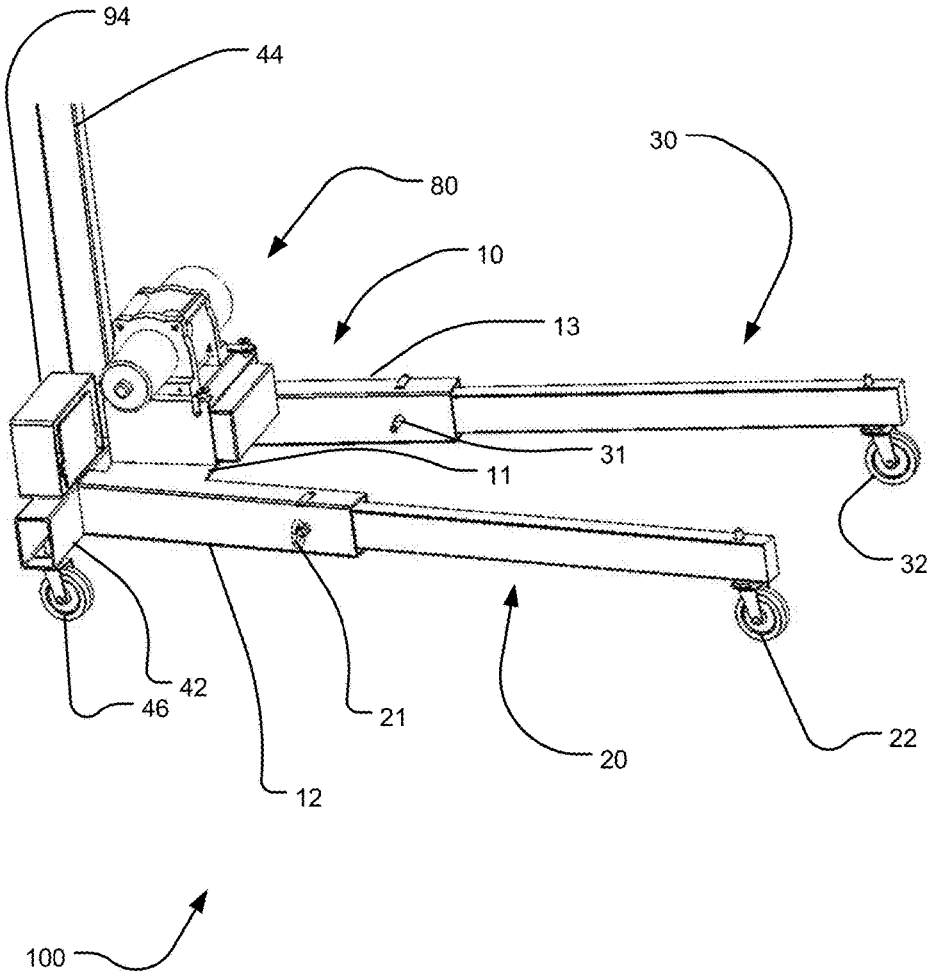
FIG. 2 illustrates a close-up right side perspective view of an exemplary embodiment of a caregiver's helper lift highlighting a lower portion.

FIG. 2 illustrates a close-up right side perspective view of an exemplary embodiment of a caregiver's helper lift 100 highlighting a lower portion. The brace base 10 is seen in more detail in FIG. 2 as are the other components that are highlighted. For example, the first balance beam extension 20 can be seen to have a locking connection mechanism called a first beam extension lock 21. Similarly, the second balance beam extension 30 has a locking connection mechanism called a second beam extension lock 31.

The power T upright 40 from FIG. 1 is illustrated in more detail in FIG. 2, where the embodiment has a substantially horizontal member called a T bar 42 and a substantially vertical member called a T stem 44 that together comprise the power T upright 40. The T bar 42 serves as the attachment point for the upper portions of the brace base 10. Also, the T bar 42 can be used to secure other components thereon such as the hoisting apparatus control system 94 (see FIG. 5 for an additional view of this component).

Individual components that comprise the brace base 10 are illustrated in detail in FIG. 2 as well. The first extension receiver 12 is attached to the T bar 42 at the first receiver's 12 proximal end and can receive in its distal end the first balance beam extension 20. The second extension receiver 13 is attached to the T bar 42 at the second receiver's proximal end and can receive in its distal end the second balance beam extension 30. In the embodiment illustrated in FIG. 2, the horizontal cross member 11 spans the first and second receivers 12 and 13 and provides a platform upon which the power plant 80 can be positioned. In other embodiments, the horizontal cross member 11 can be positioned differently (see FIGS. 11-13 for examples).

Figure 3:
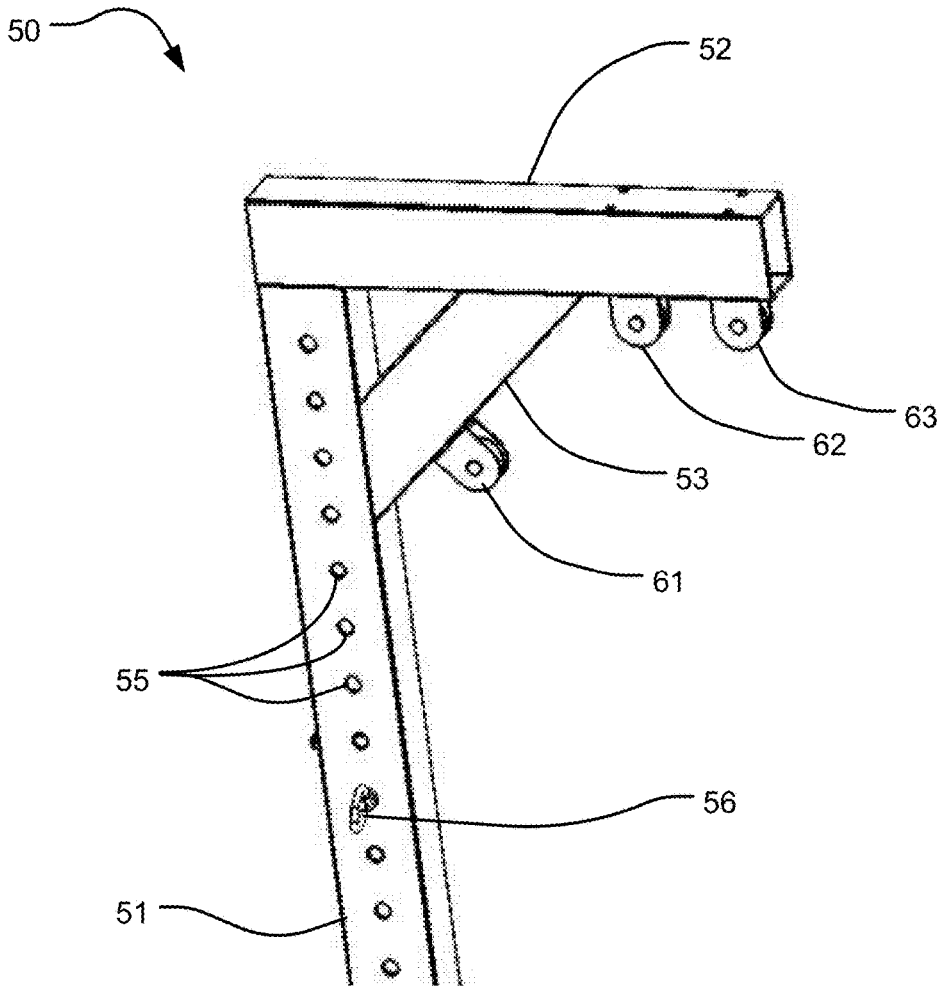
FIG. 3 illustrates a close-up right side perspective view of an exemplary embodiment of a caregiver's helper lift highlighting an upper portion.

FIG. 3 illustrates a close-up right side perspective view of an exemplary embodiment of a caregiver's helper lift 100 highlighting an upper portion. As discussed in detail under FIG. 1 above, the crane arm 50 extends the lifting point out away from the power plant 80. The crane arm 50 is able to accomplish this via the crane extension 52. The crane extension 52 connects to the crane upright 51 and extends the lifting point out from the vertical. Although not illustrated in FIG. 3, the crane extension 52 can be extendable in an alternate embodiment.

The crane upright 51 is the component of the crane arm 50 that connects to the T stem 44 of the power T upright 40 and extends the lifting point up vertically from the power plant 80. As illustrated by the embodiment shown in FIG. 3, the crane arm 50 can be adjustable in height relative to the T stem 44. This can be accomplished in a number of ways; as an example, the embodiment in FIG. 3 utilizes a plurality of crane upright lock ports 55 and a crane upright lock 56. The crane upright lock 56 can be unlocked (by removing the pin, in this embodiment) and the user can adjust the lift 100 to the desired height by sliding the crane arm 50 up and down relative to the T stem 44. When the desired height is reached, the crane upright lock 56 can be locked (by inserting the pin through one of the plurality of lock ports 55 in this embodiment), thereby ensuring that the crane upright is locked into place and ready for use. In one embodiment, the lock ports 55 are bored approximately two inches apart. In other embodiments, other spacing can be used.

Since the crane extension 52 extends outwards from the crane upright 51, it is preferable to add support to the combination to ensure that sufficient structural strength is maintained as the weight-bearing lift point is moved further out from the upright 51. In the embodiment in FIG. 3, a crane brace 53 is attached between the crane upright 51 and the crane extension 52 and serves as that added support. Furthermore, the crane brace 53 can serve as a mounting location for one or more of the plurality of lifter pulleys 61, 62, and 63.

The plurality of lifter pulleys 61, 62, and 63 serve to hold and guide the helper lift suspension 65 as it extends from the power plant 80 up the crane upright 51 and out to near the distal end of the crane extension 52. In the embodiment illustrated in FIG. 3, three lifter pulleys 61, 62 and 63 are shown; in other embodiments the number of lifter pulleys can be more or less than 3.

Note that the entire crane arm 50 can be completely removed from the lift 100. This helps reduce the storage space required for transporting and storing the lift 100. Further, a caregiver can more easily handle the individual components of the lift 100 than the entire lift 100 at once.

Figure 4:
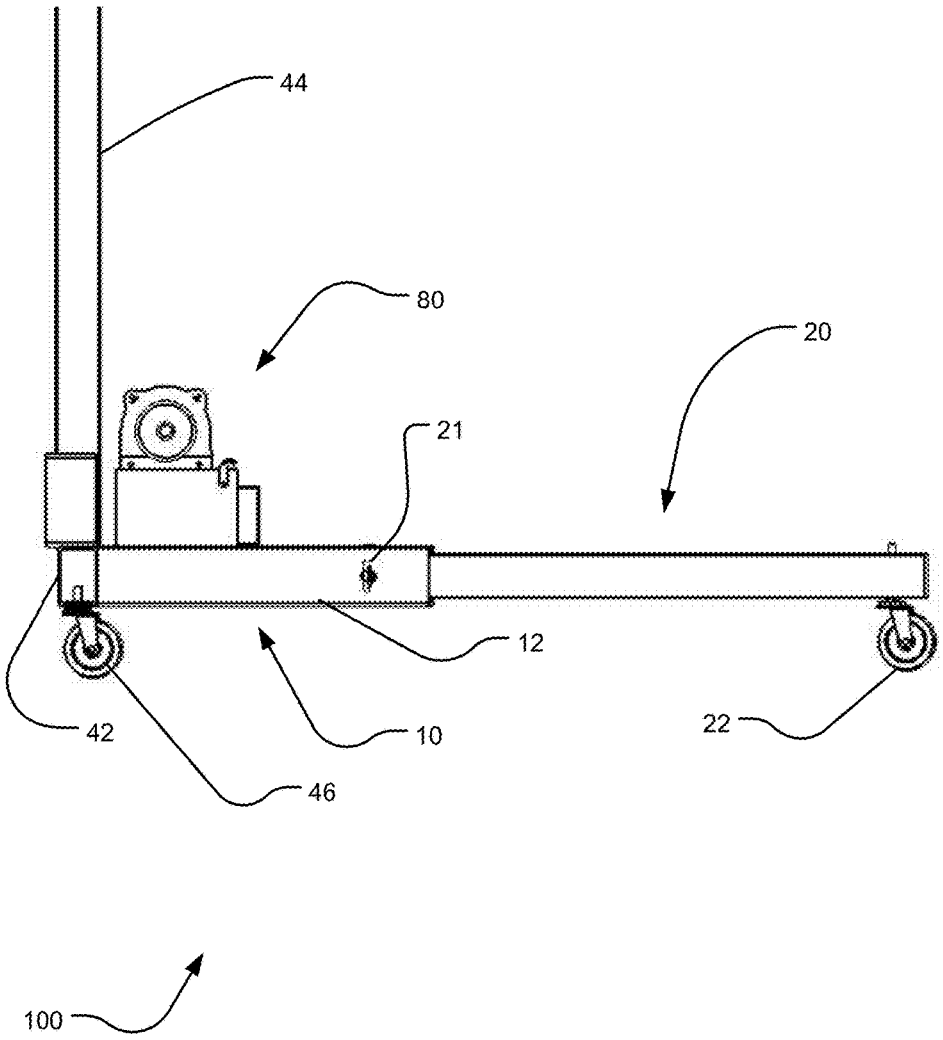
FIG. 4 illustrates a close-up right side elevation view of an exemplary embodiment of a caregiver's helper lift highlighting a lower portion.

FIG. 4 illustrates a close-up right side elevation view of an exemplary embodiment of a caregiver's helper lift 100 highlighting a lower portion. In this view, the first extension receiver 12 of the brace base 10, first balance beam extension 20, first beam extension lock 21, first balance beam extension wheel 22, T bar 42, T stem 44, T bar first wheel 46, and power plant 80 are all visible. Note how the balance beam extension 20 is relatively short in height. It is adapted to slide underneath a wheel chair so that the patient can be placed directly under the distal end of the crane extension 52 before the lift 100 is activated. This ensures that the patient does not get pulled sideways or experience undue swinging as he or she is lifted from the wheelchair. Also, the balance beam extensions extend a relatively long distance from the power plant so as to provide a wide, stable, and solid base for the lift 100. This is important as once the lift 100 begins to carry the weight of the patient, if the lift 100 were to tip over, serious injury to the patient could occur. Therefore, it is important that the lift 100 reflect the embodiments described herein in order to ensure the safe use of the lift 100.

In another embodiment, the wheels 46, 48, 22 and 32 may be repositioned so as to further decrease the height of the balance beam extensions 20 and 30 off the ground. For example, the wheels could be integrated within their mounting locations, or they may be arranged to mount off the sides of the T bar 42 and the balance beam extensions 20 and 30.

Figure 5:
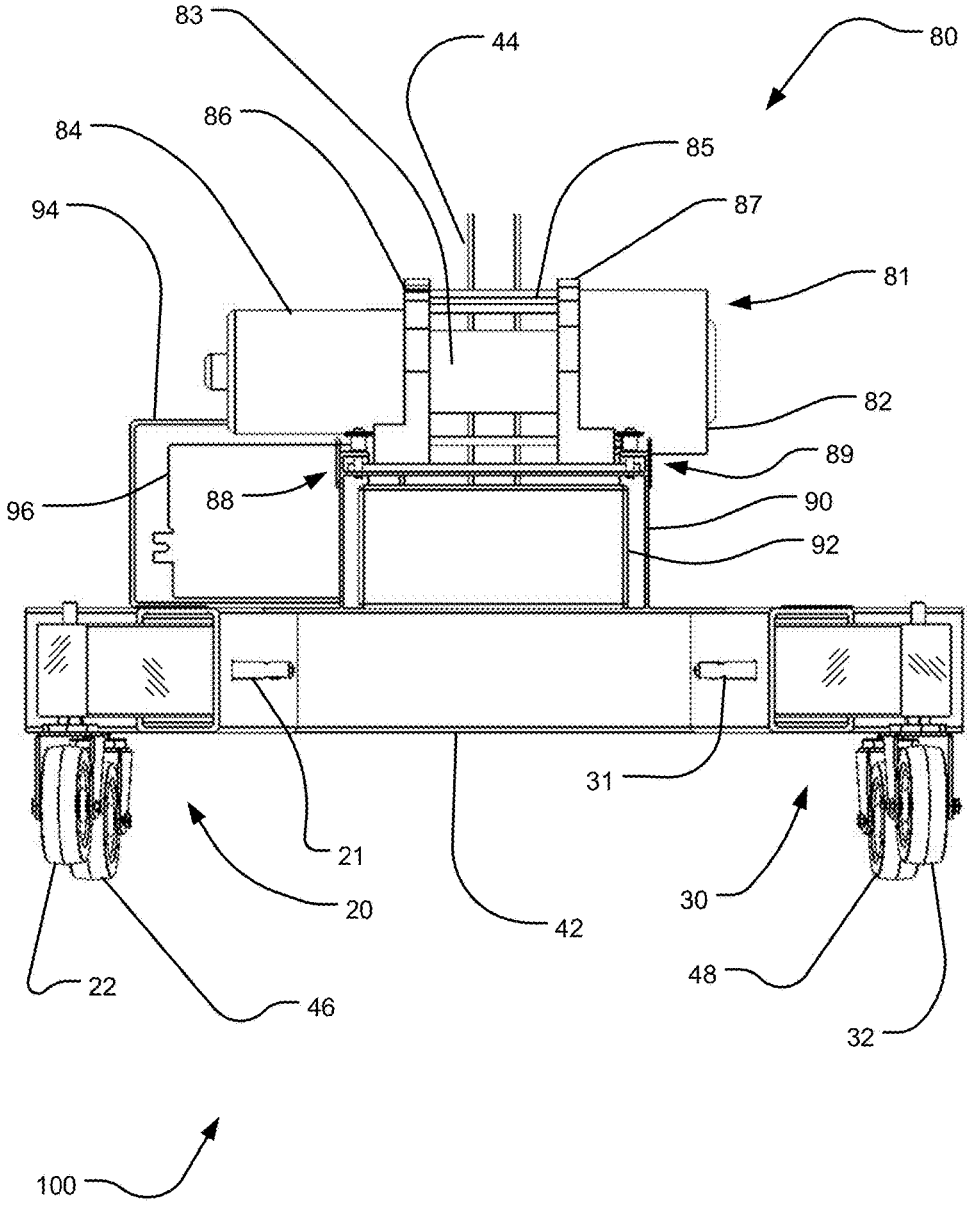
FIG. 5 illustrates a close-up front elevation view of an exemplary embodiment of a caregiver's helper lift highlighting a lower portion.

FIG. 5 illustrates a close-up front elevation view of an exemplary embodiment of a caregiver's helper lift 100 highlighting a lower portion. Although many of the same components are illustrated here as were previously described under the prior drawing FIGs., a number of new components are labeled and visible in FIG. 5.

Note that all four wheels are visible in this illustration. The T bar first wheel 46 and the T bar second wheel 48 extend a bit further down than the first and second balance beam extension wheels 22 and 32. This has the effect of raising up the T bar 42 portion of the lift 100 relative to the first and second balance beam extensions 20 and 30, thereby causing the entire lift to tilt slightly forward towards the proximal ends of the extensions 20 and 30. This design feature helps to ensure that the lift 100 does not tip over backwards. Other embodiments may not include this feature.

In the embodiment illustrated in FIG. 5, the exemplary power plant 80 is shown in detail. In this embodiment, the power plant 80 comprises a hoisting apparatus 81, a gearbox 82, a helper lift suspension spindle 83, a hoisting actuator 84, a helper lift suspension guide 85, a plurality of hoisting apparatus supports 86 and 87, a plurality of hoisting apparatus support attachments 88 and 89, a hoisting apparatus mount 90, a power source 92, a hoisting apparatus control system 94 and a control access 96.

In the embodiment of FIG. 5, the hoisting apparatus 81 comprises a hoist device that can reel-in and play-out the helper lift suspension 65 (cable/rope/etc.) as desired by the user to raise or lower the patient who is connected thereto via an exemplary lifting harness 69. In other embodiments other devices besides a hoist which can reel-in and play-out the helper lift suspension 65 are contemplated.

The hoisting apparatus 81 utilizes a gearbox 82 to reduce the speed of line retrieval or release while increasing the power of same. The hoisting actuator 84 is a hoist motor in the embodiment of FIG. 5. The motor spins too quickly to directly drive the helper lift suspension spindle 83 which winds or releases the helper lift suspension 65 therearound, so the gearbox 82 reduces the speed and increases the power. The hoisting actuator 84, spindle 83, and gearbox 82 (and other components, as needed) must act in concert to ensure that the helper lift suspension 65 is retrieved and let out at a generally constant, relatively slow rate so that the patient is jerked suddenly upwards or downwards.

The helper lift suspension guide 85 serves to guide the helper lift suspension 65 as it enters or leaves the spindle 83. In other embodiments a guide 85 is not used.

A plurality of hoisting apparatus supports 86 and 87 are illustrated in FIG. 5. These supports 86 and 87 ensure strong attachment between the components of the power plant 80 so that they don't come apart while the lift is in operation. The supports are attached to the hoisting apparatus 81; they also attach to a hoisting apparatus mount 90 via the plurality of hoisting apparatus support attachments 88 and 89. The mount 90 is firmly attached to the brace base 10 so that the entire power plant 80 is secured. The hoist apparatus 81 includes a power source 92 which can be a battery, a rechargeable battery, an attachment to household or vehicle power, or any other suitable power source. Additional components illustrated in FIG. 5 include a hoisting apparatus control system 94 and a control access 96. The control access 96 serves as a door to allow access into the control system 94. The control system provides the necessary electronics to run the hoisting apparatus, remote controls, connection for manual control switches, etc.

Figure 6:
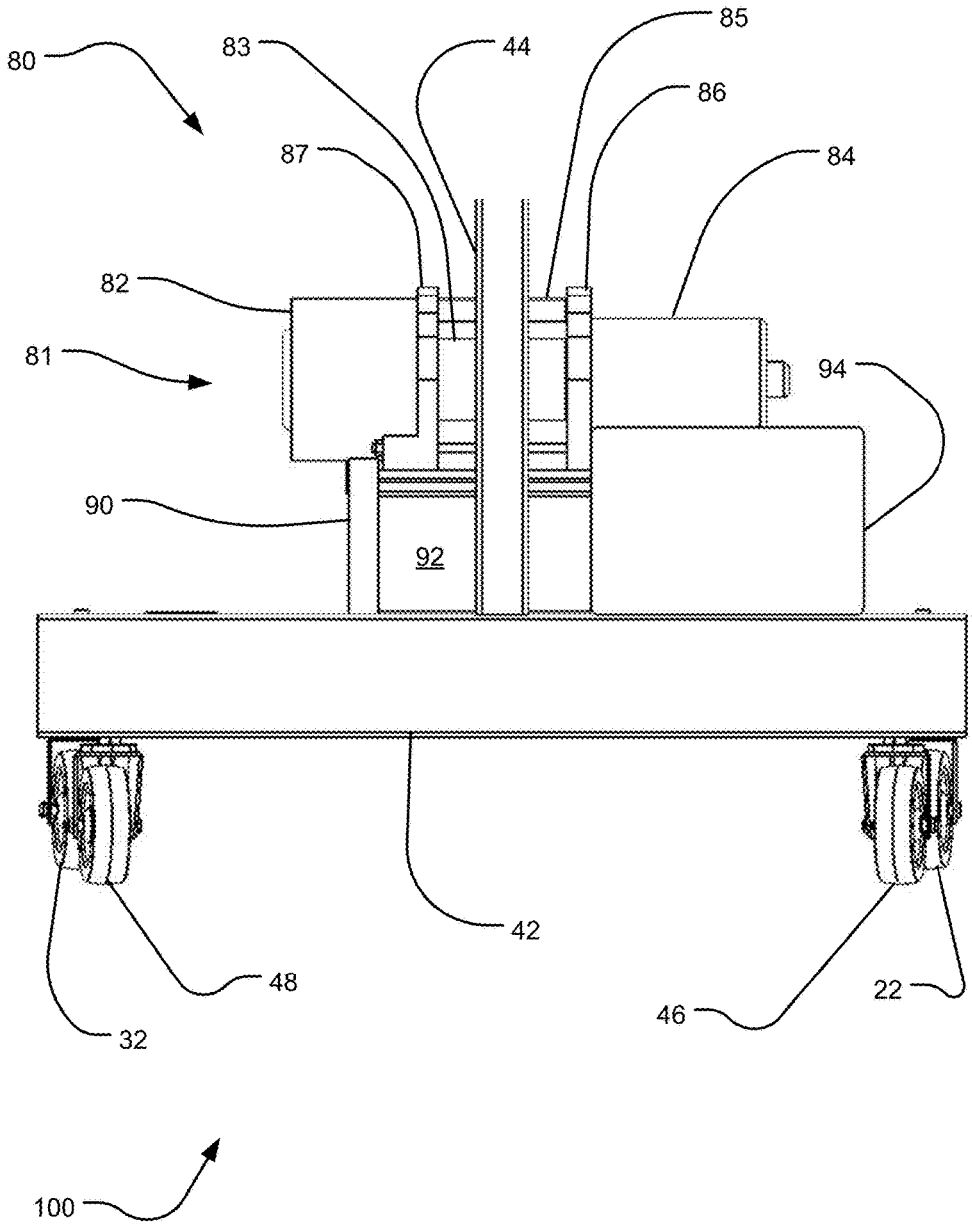
FIG. 6 illustrates a close-up rear elevation view of an exemplary embodiment of a caregiver's helper lift highlighting a lower portion.

FIG. 6 illustrates a close-up rear elevation view of an exemplary embodiment of a caregiver's helper lift 100 highlighting a lower portion. This view shows the rear side of many of the components discussed in FIG. 5, above. The lift 100 can be used to lift, transport, lower, and reposition a patient into and out of a wheelchair (or other similar device), into and out of a vehicle, down to the floor and back up into a wheelchair, onto and off of a toilet, etc.

Figure 7:
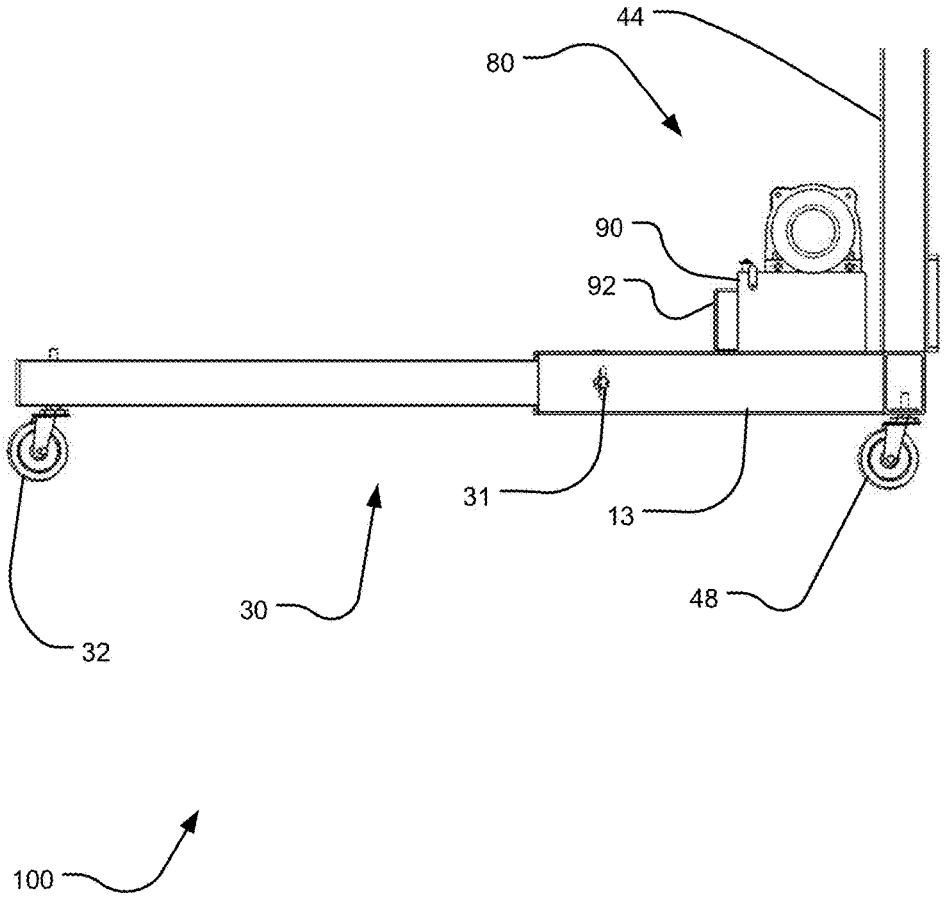
FIG. 7 illustrates a close-up left side elevation view of an exemplary embodiment of a caregiver's helper lift highlighting a lower portion.

FIG. 7 illustrates a close-up left side elevation view of an exemplary embodiment of a caregiver's helper lift 100 highlighting a lower portion. In this view, it is apparent that the power plant 80 can be located in proximity to the T stem 44 and yet not contact said T stem 44. In other embodiments, the power plant 80 may also be attached to or contact the T stem 44. In yet other embodiments, the power plant 80 may be mounted on the other side of the T stem 44 (see FIGS. 11-13).

Note that the second balance beam extension 30 appears in FIG. 7 as if it may be adjustable in length since it is shown in this embodiment as sliding into the brace base 10. In one embodiment, the first and second balance beam extensions 20 and 30 are not adjustable in length, they can simply be removed and reattached as needed to the brace base 10. In another embodiment, however, the extensions 20 and 30 can be made to adjustably slide in and out of the extension receivers 12 and 13 so as to effectively change lengths.

Figure 8:
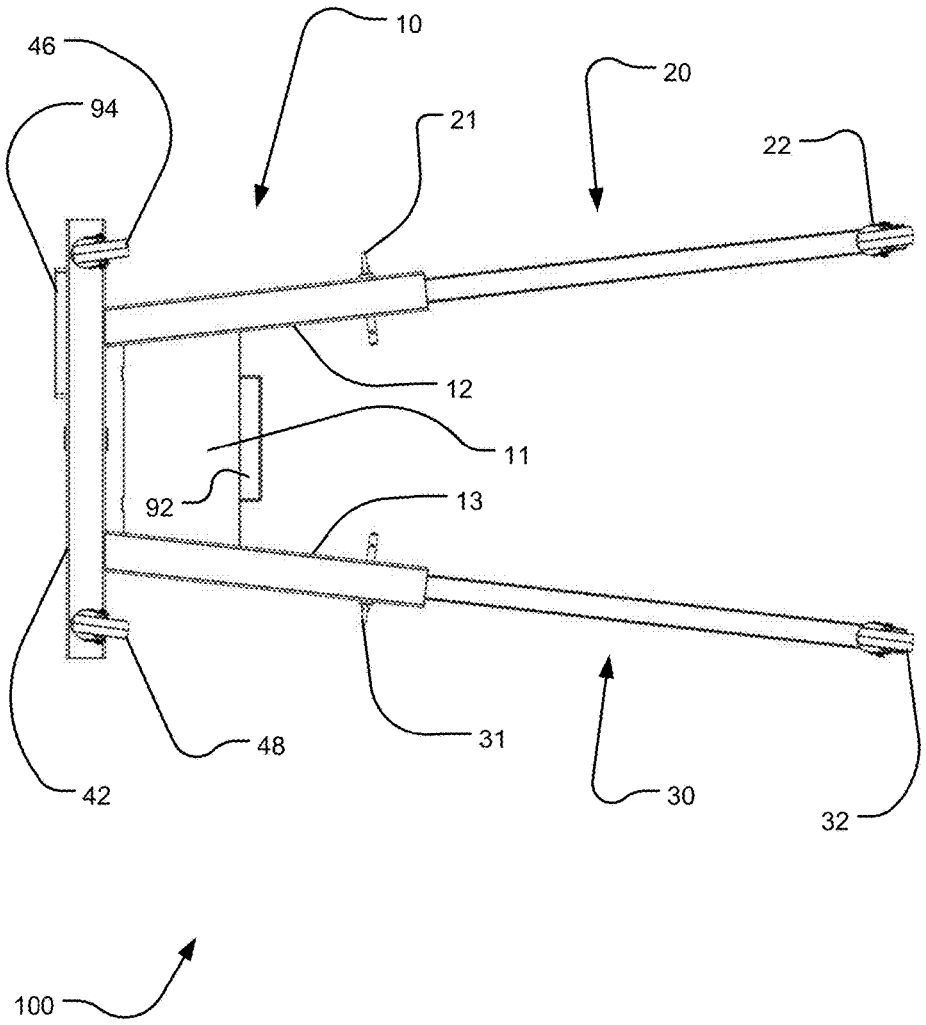
FIG. 8 illustrates a bottom plan view of an exemplary embodiment of a caregiver's helper lift highlighting a lower portion.

FIG. 8 illustrates a bottom plan view of an exemplary embodiment of a caregiver's helper lift 100 highlighting a lower portion. In this view, the location of the brace base 10 relative to the other components can be more clearly understood. It is apparent that the brace base 10 forms the base of the lift 100, utilizing the first and second extension receivers 12 and 13 to connect to the balance beam extensions 20 and 30, respectively. In this embodiment, the first and second extension receivers 12 and 13 are connected to the T bar 42 as well as to the horizontal cross member 11 which holds the power plant 80.

The embodiment illustrated in FIG. 8 also has the beam extensions 20 and 30 angled out substantially from the T bar 42; this helps to provide a wider and more supportive structure to help ensure that the lift does not tip when in use. However, as some door frames are less than twenty four inches wide, one embodiment has the maximum width of the lift as twenty two inches (across the distal ends of the beam extensions 20 and 30, and the width of the T bar 42). Other widths are contemplated in other embodiments.

Figure 9:
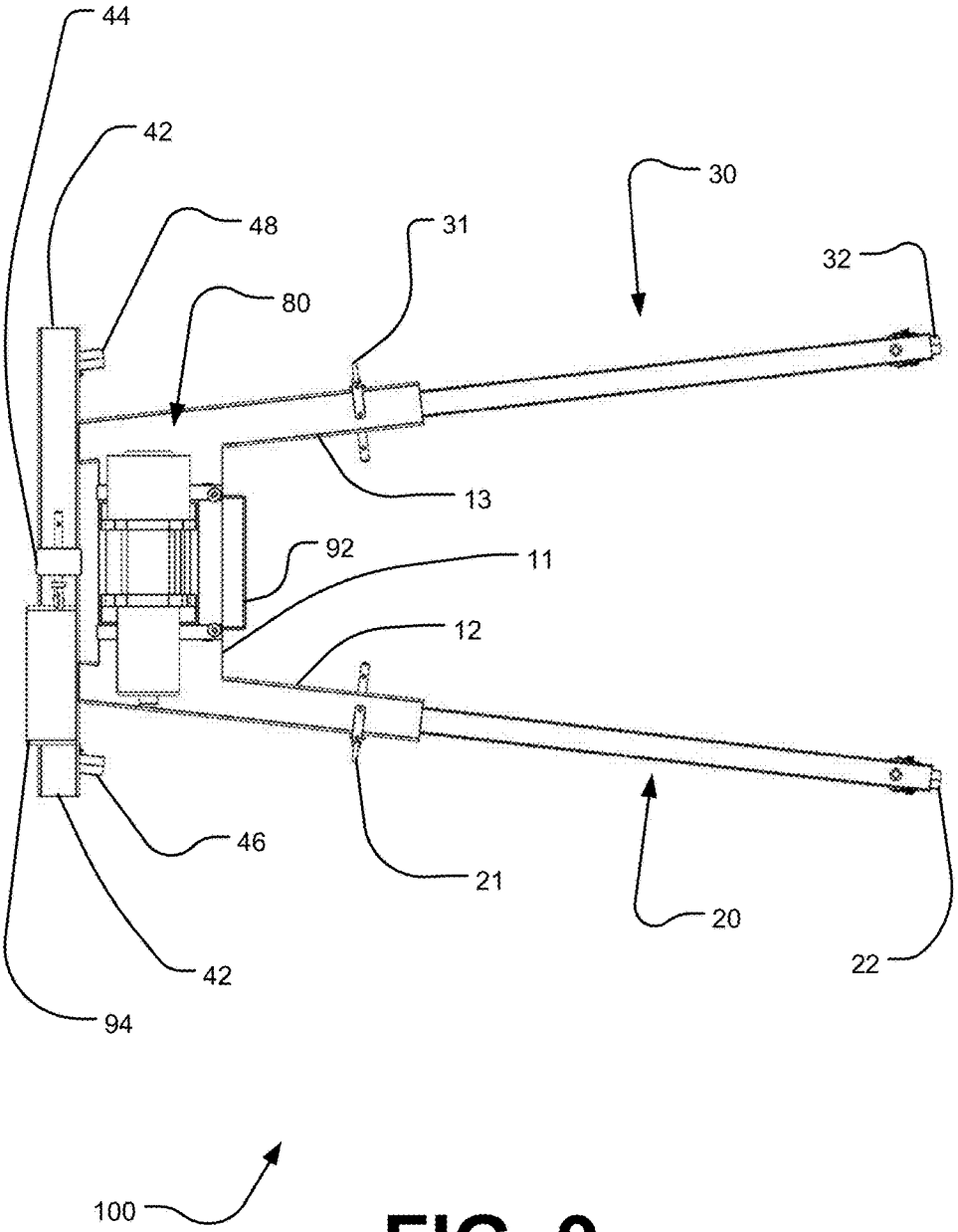
FIG. 9 illustrates a top plan view of an exemplary embodiment of a caregiver's helper lift highlighting a lower portion.

FIG. 9 illustrates a top plan view of an exemplary embodiment of a caregiver's helper lift 100 highlighting a lower portion. As seen from above, the power plant 80 is positioned upon, and supported by, the horizontal cross member 11. Note that the first beam extension lock 21 can be unlocked and the first beam extension 20 can be withdrawn from the first extension receiver 12. Similarly, the second beam extension lock 31 can be unlocked and the second beam extension 30 can be withdrawn from the second extension receiver 13. By removing both beam extensions 20 and 30, the lift 100 is significantly reduced in size. Furthermore, the components can be handled individually, substantially reducing the burden on the caregiver as individual components weigh much less than the entire lift 100.

Figure 10:
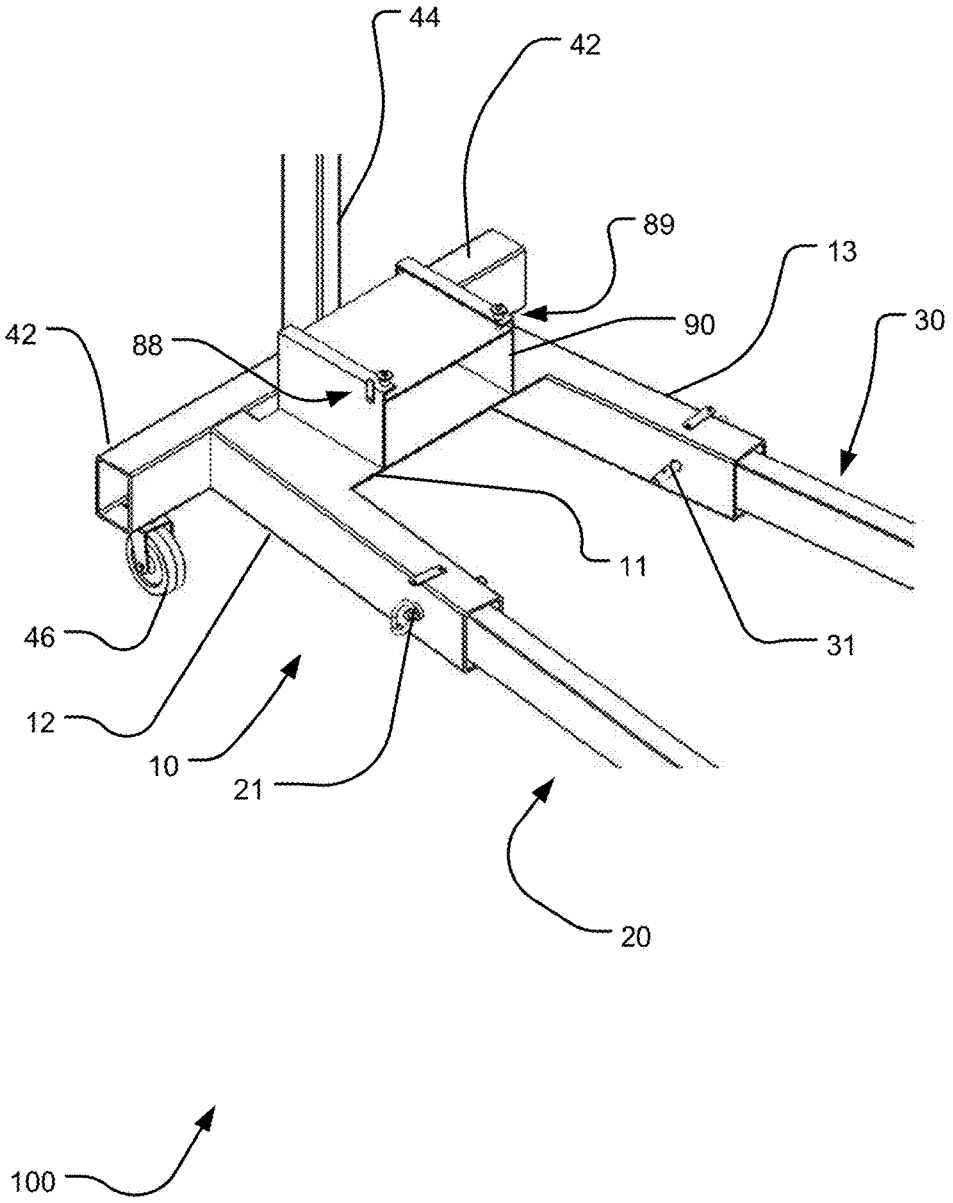
FIG. 10 illustrates a right side front perspective view of an exemplary embodiment of a caregiver's helper lift highlighting a lower portion.

FIG. 10 illustrates a perspective front view of an exemplary embodiment of a caregiver's helper lift highlighting a lower portion. This close-up view lacks many of the power plant components 80, so it is possible to see the brace base 10 attached to the T bar 42 and the beam extensions 20 and 30. When used to load a patient into a vehicle, the short height of the caster wheels becomes extremely valuable as the beam extensions 20 and 30 are slid underneath the vehicle as the crane extension 52 and the patient are positioned in the vehicle above the passenger seat.

The process of loading a patient from a wheelchair and into a vehicle is as follows. The lift 100 is positioned parallel with the vehicle with the first and second balance beam extensions 20 and 30 pointed towards the rear of the vehicle. The patient is sitting in the wheelchair and the two are positioned over the beam extensions 20 and 30 with the patient directly under the distal end of the crane extension 52 where the helper lift suspension 65 extends downwards into the patients lap. The removable lift attachment 67 can then be clipped onto the center lift portion of the lifting harness 69 (also known as a climbing harness). The patient will have previously donned the harness and ensured it was correctly positioned on his or her waist and legs. The hoisting apparatus 81 is then activated, winding up the helper lift suspension 65 on the spindle 83 and lifting the patient up and out of the wheelchair. The wheelchair can then be placed out of the way.

With the patient suspended in the lift 100, the entire lift 100 is turned ninety degrees so that the crane extension 52 points into the passenger compartment of the vehicle and the beam extensions 20 and 30 are under the vehicle. An accessory rope can be attached to the leg strap of the climbing harness with the other end of the rope wrapped around the steering wheel post of the vehicle and brought back to the patient or the caregiver. Either person can then pull on the rope, effectively pulling the patient further into the vehicle and ensuring that he or she is facing forward and properly positioned above the vehicle's seat. The lift 100 can then be reversed to lower the patient into the seat. The accessory rope can be removed and the removable lift attachment 67 (which can be a carabiner) can be detached from the harness. The lift 100 can then be wheeled around to the trunk or backseat where it can be used to load the wheelchair into the vehicle (a dedicated wheelchair sling can be provided, or the removable lift attachment 67 can be clipped to the wheelchair if an appropriate lift point is already attached thereto. The lift 100 itself can then be disassembled and placed into the vehicle. The above process is reversed to unload a patient from a vehicle and place him or her into a wheelchair.

In yet another embodiment, the middle cross member of the H is not used; and instead, the power plant 80 is cantilevered off the other side of the power T upright 40 (opposite the side of the brace base 10 connected to the first and second balance beam extensions 20 and 30). See FIGS. 11 and 12 for additional examples of such embodiments.

Figure 11:
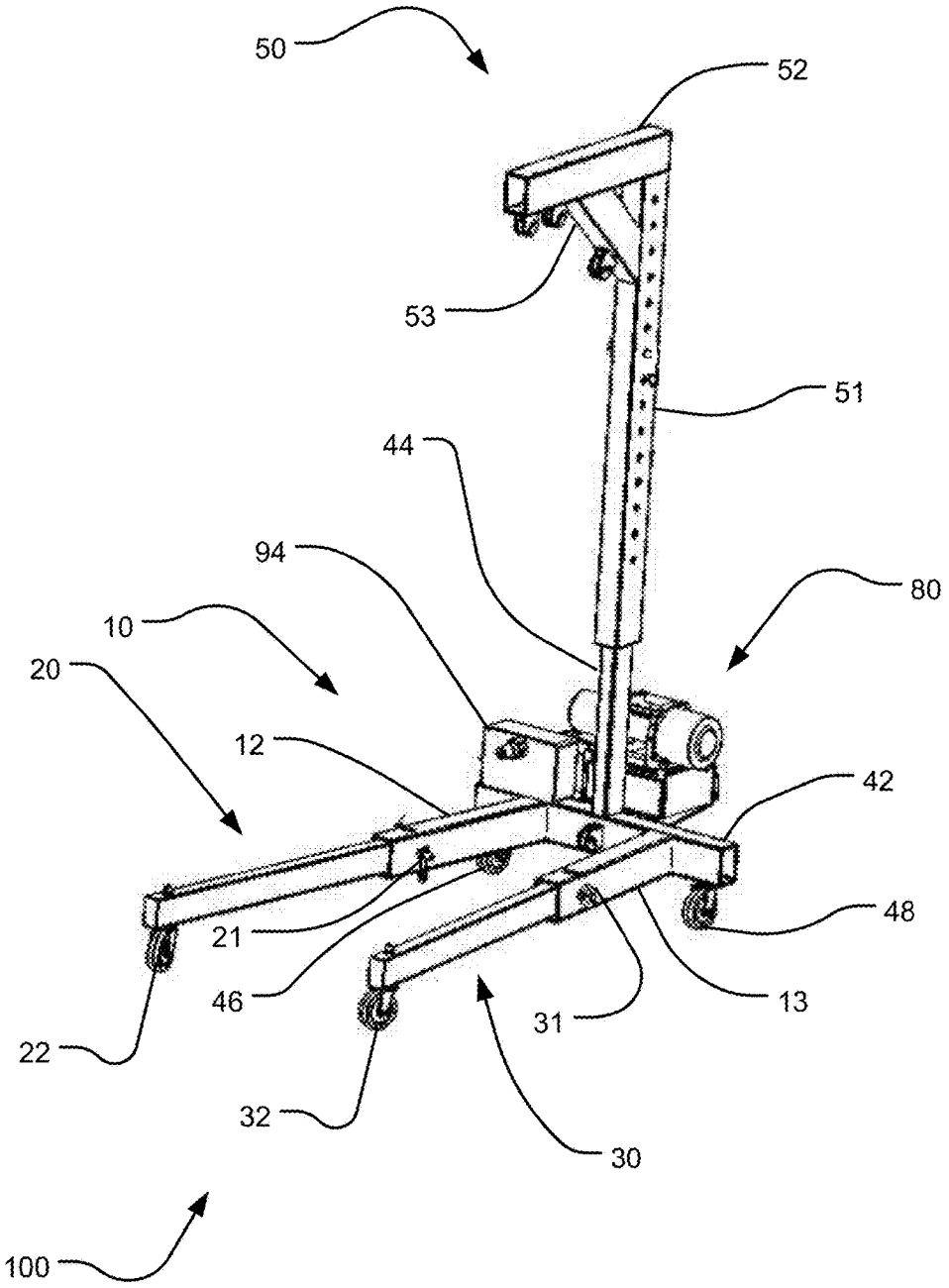
FIG. 11 illustrates a left side front perspective view of another exemplary embodiment of a caregiver's helper lift with an alternate power plant mounting location.

FIG. 11 illustrates a left side front perspective view of another exemplary embodiment of a caregiver's helper lift 100 with an alternate power plant 80 mounting location. In this embodiment, the brace base 10 comprises a first extension receiver 12 and a second extension receiver 13, both connected at their proximal ends to the front side of the T bar 42. However, the horizontal cross member 11 (not labeled in FIG. 11, see FIGS. 12-13) does not span across the two receivers 12 and 13. Instead, the horizontal cross member 11 is mounted to the rear side of the T bar 42. In this configuration, the power plant 80 is therefore not located above the receivers 12 and 13 and so there is more room for a wheelchair and/or patient between the receivers 12 and 13 and the crane extension 52.

Figure 12:
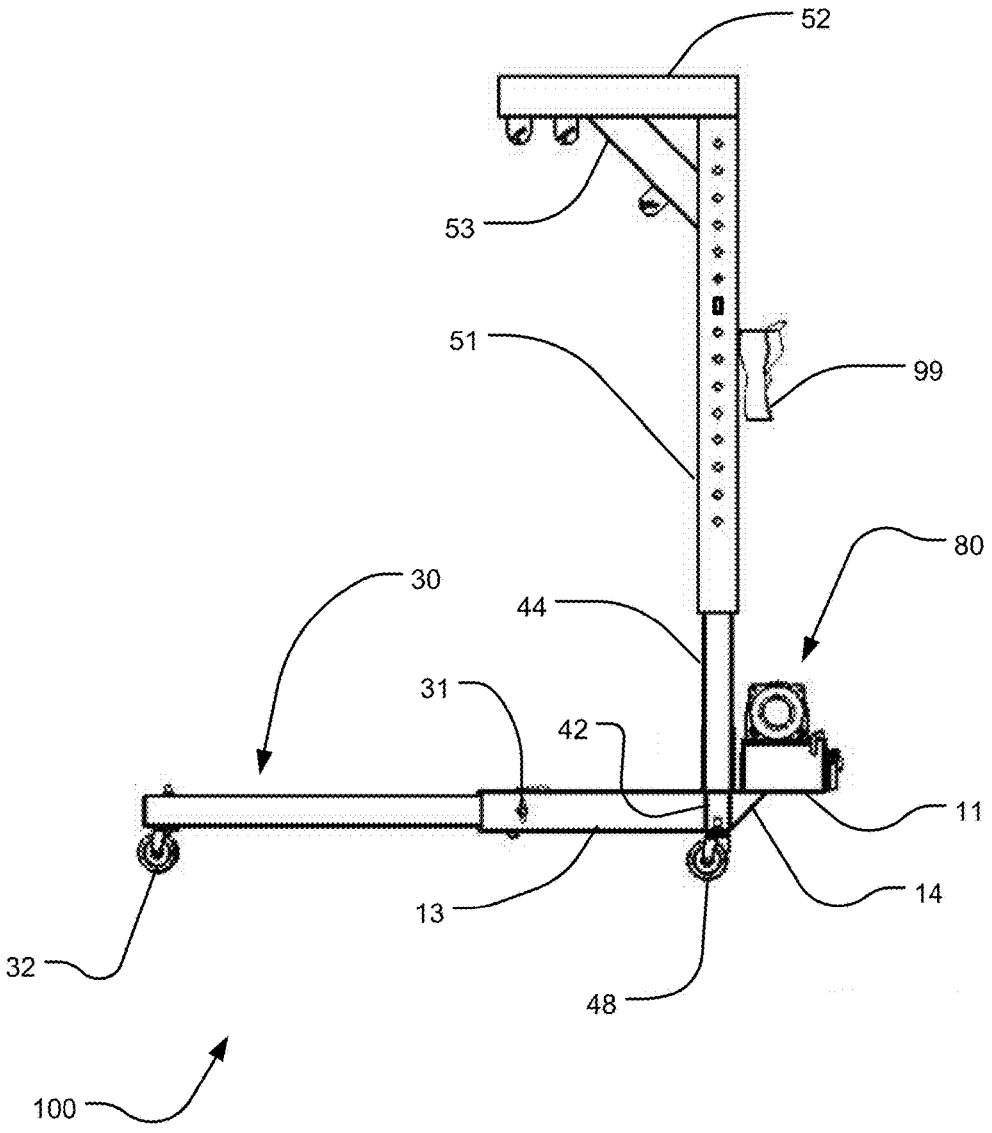
FIG. 12 illustrates a left side elevation view of another exemplary embodiment of a caregiver's helper lift with an alternate power plant mounting location.

FIG. 12 illustrates a left side elevation view of another exemplary embodiment of a caregiver's helper lift 100 with an alternate power plant 80 mounting location. FIG. 12 shows the horizontal cross member 11 mounted on the rear side of the T bar 42. There is a cross brace 14 illustrated in FIG. 12 to help the horizontal cross member 11 support the weight of the power plant 80 and the stresses that develop during operation.

Also illustrated in FIG. 12 is a remote control 99. This device can be connected to the hoisting apparatus control system 94 via control wires or wirelessly. In either case, it allows the patient, caregiver, etc. to remotely control the operation of the lift 100 without having to be in close proximity to the power plant 80. This allows the person controlling the lift to further assist the patient, monitor clearances, steady the lift, etc. in addition to controlling the lifting/lowering features of the device. The remote control 99 can be releasably mounted on the crane upright 51, or it can be permanently mounted thereto. Other locations for storage/mounting of the remote control 99 are contemplated.

Figure 13:
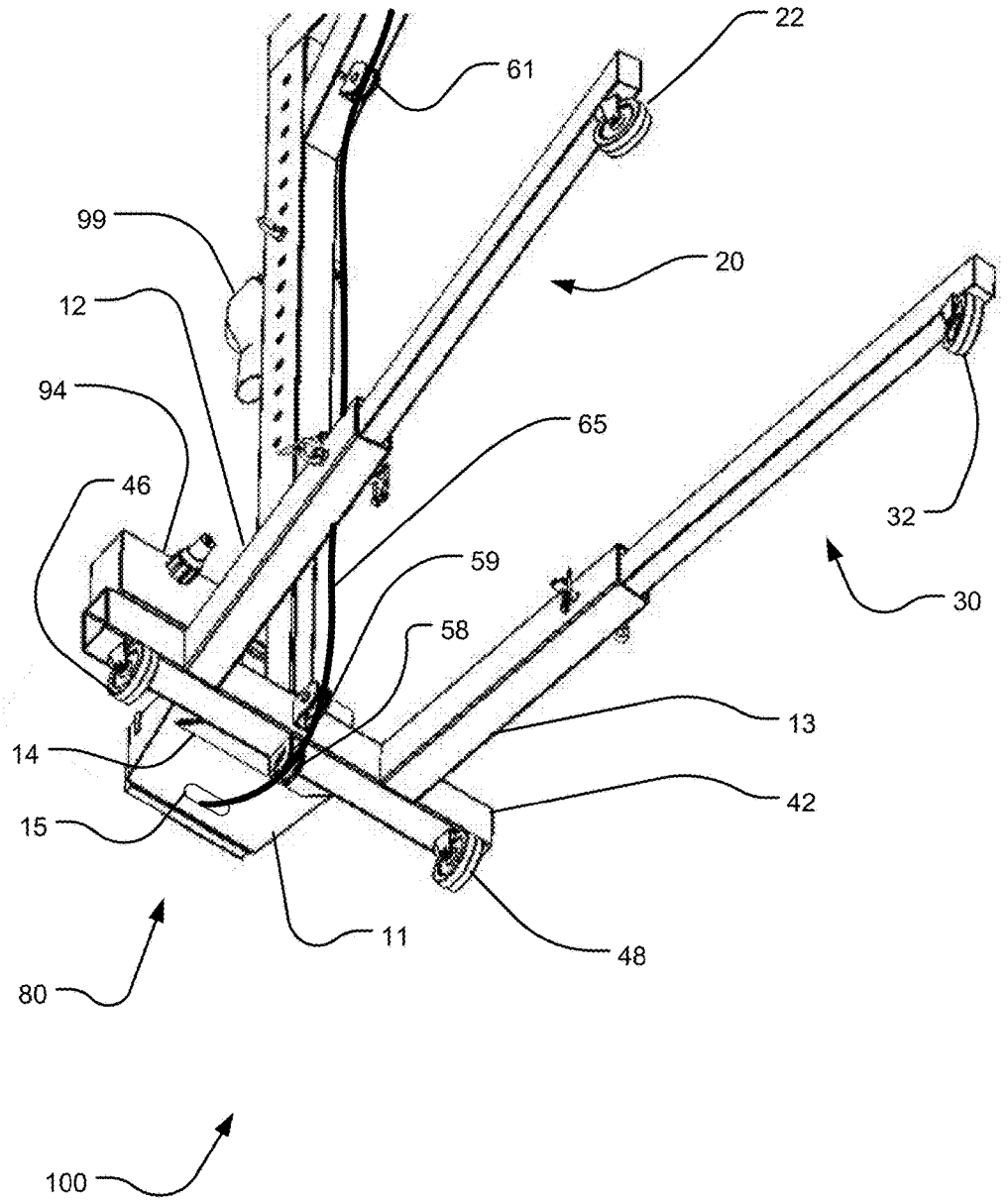
FIG. 13 illustrates a bottom front perspective view of another exemplary embodiment of a caregiver's helper lift with an alternate power plant mounting location.

FIG. 13 illustrates a bottom front perspective view of another exemplary embodiment of a caregiver's helper lift 100 with an alternate power plant 80 mounting location. In this view, the plurality of lifter pulleys is shown to potentially include a base pulley 58 and a T bar pulley 59. These are useful for redirecting the helper lift suspension 65 from the cross member port 15, under the T bar 42, and to the front of the power T upright. The helper lift suspension 65 then continues upwards to the pulley 61 as in the earlier embodiments where the power plant 80 is in front of the T bar 42.

Note that the cross member port 15 provides an access port through which the helper lift suspension 65 can pass from the spindle 83 (see FIG. 5). In alternate embodiments, the spindle 83 is positioned far enough to the rear that no cross member port 15 is necessary. In yet another embodiment, the horizontal cross member 11 could be mounted higher on the power T upright and the power plant could be mounted on the underside of the horizontal cross member 11. Other component arrangements are contemplated.

Figure 14:
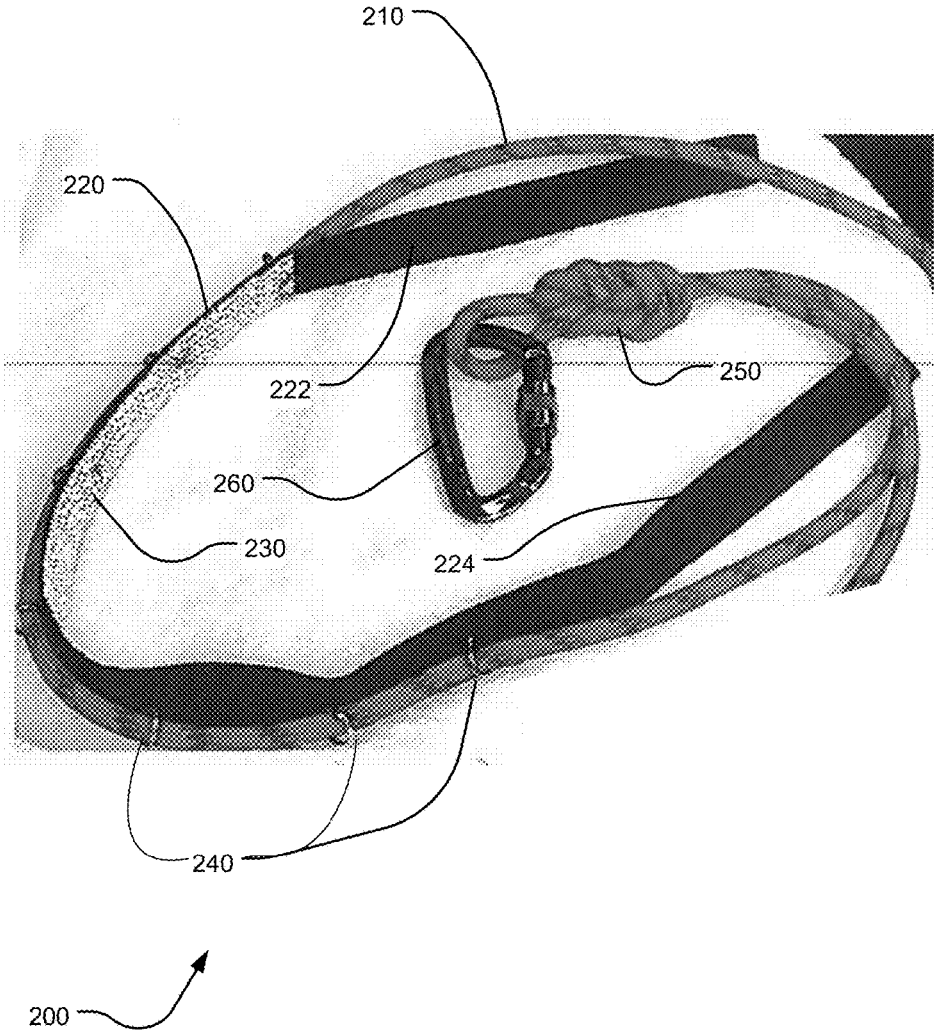
FIG. 14 illustrates a top perspective view of an exemplary embodiment of a position adjustment line holder.

FIG. 14 illustrates a top perspective view of an exemplary embodiment of a position adjustment line holder 200. The position adjustment line holder 200 illustrated in FIG. 14 comprises a position adjustment line 210, a friction collar 220, a plurality of slide rings 240, an attachment holder 250, and a harness attachment 260. The friction collar 220 is designed to wrap over, around, or on a strong point which can be used as an anchor to allow the patient or caregiver to adjust the position of the patient by pulling on the position adjustment line 210. The friction collar 220 can have a relatively high friction surface 230 which can be integral to the friction collar 220 or can be an attached high friction material on the inner surface. The high friction surface 230 works to hold the friction collar 220 in place on the strong point/anchor. In many instances, the strong point will be the steering column on a vehicle. At other times, it can be a handicap pull bar, or some other strong point. Conversely, the outer surface can be silk, satin, or some other low friction material that allows the position adjustment line 210 to slide easily over the friction collar 220. A plurality of slide rings 240 function to keep the position adjustment line 210 in place on top of the outer surface of the friction collar 220.

A friction collar first end 222 is configured to removably and adjustably attach to a friction collar second end 224. In one embodiment, hook and loop material is used as attachment devices, in other embodiments, other means of releasably and adjustably attaching the two friction collar ends 222 and 224 to one another are contemplated.

At one end of the position adjustment line 210 is an attachment holder 250 which attaches the position adjustment line 210 to the harness attachment 260. The harness attachment 260 in the illustration in FIG. 14 is a carabiner. In other embodiments, other devices are used for the harness attachment 260. The harness attachment 260 attaches the position adjustment line 210 to the lifting harness 69 on the patient.

Figure 15:
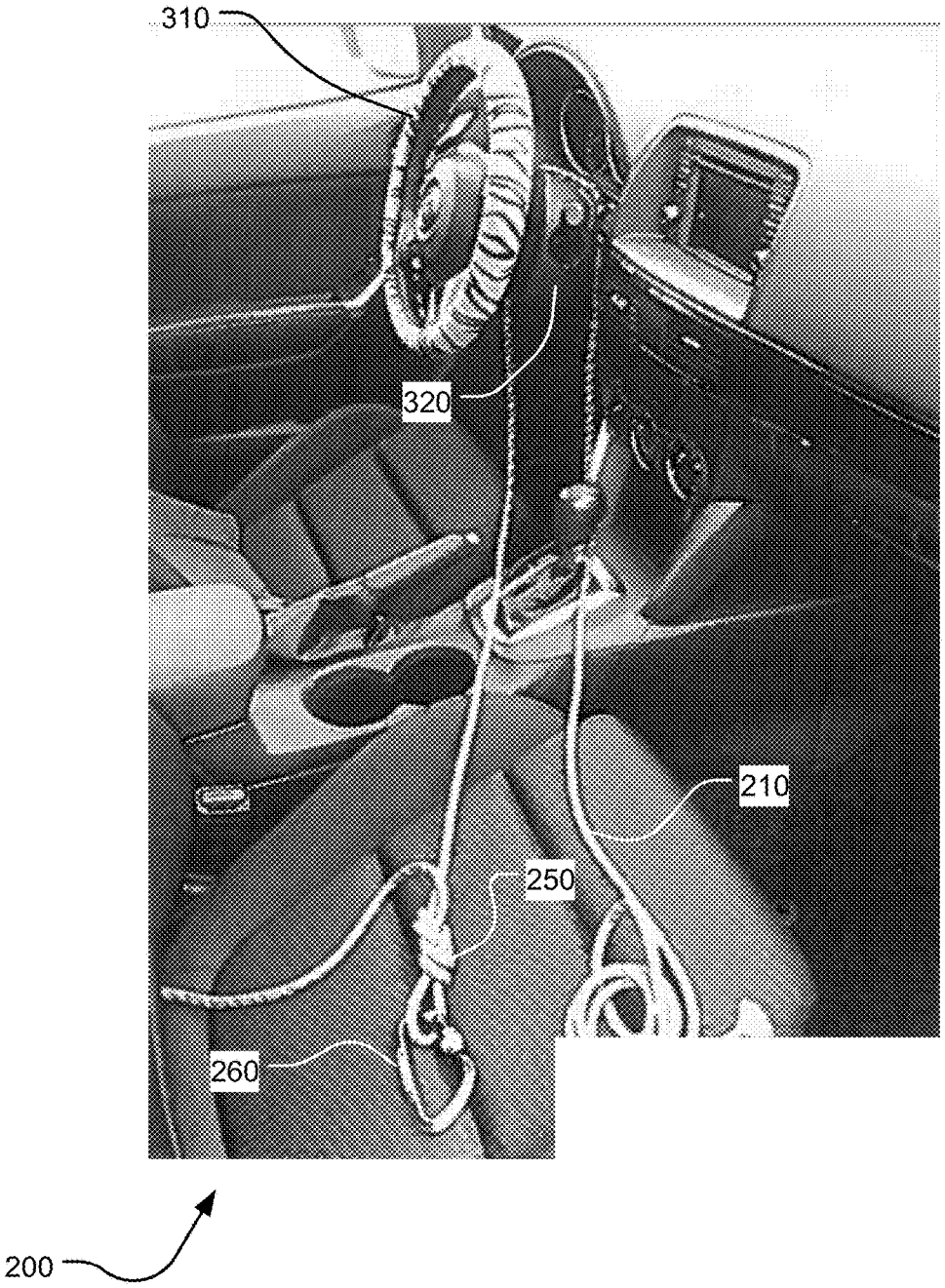
FIG. 15 illustrates a side perspective view of an exemplary embodiment of a position adjustment line holder in position on a steering wheel column and ready for attachment to a patient via a lifting harness.

FIG. 15 illustrates a side perspective view of an exemplary embodiment of a position adjustment line holder 200 in position on a steering column 320 below the steering wheel 310. In this example, a position adjustment line holder 200 can be used by a patient who is suspended by a caregiver's helper lift 100 (see earlier Figures) in the passenger side of a vehicle. The helper lift 100 positions the patient near to the correct position, but the patient needs to be slid further into the vehicle. In order to accomplish this, it is much easier to pull the patient further into the vehicle before lowering them completely into place on the passenger seat than to have them attempt to push themselves sideways once they are sitting on the seat. The process is best accomplished using a position adjustment line holder 200 which is wrapped around the steering column 320 of the vehicle. The high friction side of the friction collar 220 is placed around the steering column and grips the steering column in order to keep the collar in place. The position adjustment line 210 attaches to the patient on one end, wraps around the steering column by passing through the plurality of slide rings 240 and over the low friction side of the collar 220. The patient (or caregiver) can then pull on the other end of the position adjustment line 210 and thereby pull the patient towards the steering column until he/she is properly positioned above the passenger seat. At that time, the patient can be lowered the remaining distance onto the seat and the harness attachment 260 can be detached from the patient's harness.

While particular embodiments have been described and disclosed in the present application, it is clear that any number of permutations, modifications, or embodiments may be made without departing from the spirit and the scope of this disclosure.

Particular terminology used when describing certain features or aspects of the embodiments should not be taken to imply that the terminology is being redefined herein to be restricted to any specific characteristics, features, or aspects with which that terminology is associated. In general, the terms used in the following claims should not be construed to be limited to the specific embodiments disclosed in the specification, unless the above Detailed Description section explicitly defines such terms. Accordingly, the actual scope of the claims encompasses not only the disclosed embodiments, but also all equivalent ways of practicing or implementing the claimed subject matter.

The above detailed description of the embodiments is not intended to be exhaustive or to limit the disclosure to the precise embodiment or form disclosed herein or to the particular fields of usage mentioned above. While specific embodiments and examples are described above for illustrative purposes, various equivalent modifications are possible within the scope of the disclosure, as those skilled in the relevant art will recognize Also, the teachings of the embodiments provided herein can be applied to other systems, not necessarily the system described above. The elements and acts of the various embodiments described above can be combined to provide further embodiments.

Any patents, applications and other references that may be listed in accompanying or subsequent filing papers, are incorporated herein by reference. Aspects of embodiments can be modified, if necessary, to employ the systems, functions, and concepts of the various references to provide yet further embodiments.

In light of the above "Detailed Description," the Inventor may make changes to the disclosure. While the detailed description outlines possible embodiments and discloses the best mode contemplated, no matter how detailed the above appears in text, embodiments may be practiced in a myriad of ways. Thus, implementation details may vary considerably while still being encompassed by the spirit of the embodiments as disclosed by the inventor. As discussed herein, specific terminology used when describing certain features or aspects should not be taken to imply that the terminology is being redefined herein to be restricted to any specific characteristics, features, or aspects of the embodiments with which that terminology is associated.

While certain aspects are presented below in certain claim forms, the inventor contemplates the various aspects in any number of claim forms. Accordingly, the inventor reserves the right to add additional claims after filing the application to pursue such additional claim forms for other aspects.

The above specification, examples and data provide a description of the structure and use of exemplary implementations of the described systems, articles of manufacture and methods. It is important to note that many implementations can be made without departing from the spirit and scope of the disclosure.

What is claimed is:

1. A caregiver's helper lift assembly, comprising:

a brace base extending generally horizontally wherein the brace base comprises a first extension receiver and a second extension receiver, and wherein the brace base is connected at a brace base proximal end to a power T upright;

the power T upright having a substantially horizontal T bar member and a substantially vertical T stem member wherein the T bar member is attached to the brace base;

a crane arm comprising a crane upright and a crane extension;

the crane upright removably engaged with the T stem member and extending generally upwards therefrom;

the crane extension attached to the crane upright and wherein the crane extension extends generally away from the vertical;

a horizontal cross member attached to the T bar member;

the horizontal cross member adapted to hold thereon a power plant;

the power plant comprising at least a hoisting apparatus, a power source, and a hoisting apparatus control system;

the hoisting apparatus adapted to take-in and play-out a helper lift suspension;

the helper lift suspension having a helper lift suspension proximal end and a helper lift suspension distal end and wherein the helper lift suspension proximal end is attached to the hoisting apparatus;

the helper lift suspension threaded through a plurality of lifter pulleys, the plurality of lifter pulleys comprising: a first and second lifter pulley mounted to the crane extension; a base pulley mounted to a bottom side of the T bar member, and a T bar pulley mounted to a front facing side of the T bar member such that the T bar pulley extends between the first and second extension receivers, wherein the plurality of lifter pulleys are configured to direct the helper lift suspension under the bottom side of the T bar member, to the front facing side of the T bar member, between the first and second extension receivers, along the T stem member, the crane upright, and the crane extension such that the helper lift distal end extends from the crane extension;

a lifting harness that is adapted to be worn by a patient and configured to be releasably attached to the helper lift suspension distal end such that the hoisting apparatus can take-in the helper lift suspension and thereby suspend the lifting harness below the crane extension;

the hoisting apparatus control system adapted to allow a caregiver to raise and lower the lifting harness by operating the hoisting apparatus to take-in and play-out, respectively, the helper lift suspension;

a position adjustment line holder comprising a position adjustment line which passes through a plurality of slide rings over a friction collar, a first end of the position adjustment line having a harness attachment which is used to attach the position adjustment line to the lifting harness;

the friction collar adapted to wrap around a steering column on a vehicle so that one of a patient and a caregiver can pull on a second end of the position adjustment line and position the patient closer to the steering column;

a first balance beam extension removably attached to the brace base and extending generally horizontally therefrom and a second balance beam extension removably attached to the brace base and extending generally horizontally therefrom;

a first balance beam extension wheel attached to the first balance beam extension and a second balance beam extension wheel attached to the second balance beam extension;

a T bar first wheel attached to the T bar member;

a T bar second wheel attached to the T bar member; and the power source adapted to provide power to the hoisting apparatus so that the hoisting apparatus can take-in and play-out the helper lift suspension on demand.

2. The caregiver's helper lift assembly of claim 1 wherein the crane arm is adjustably engaged with the T stem member such that the crane arm can be raised and lowered in relation to the T stem member and locked in place.

3. The caregiver's helper lift assembly of claim 2 wherein the crane upright has a plurality of crane upright lock ports and a crane upright lock is adapted to be placed through the crane upright lock ports and through the T stem member in order to lock the crane arm to the T stem member.

4. The caregiver's helper lift assembly of claim 1 wherein the first extension receiver is adapted to removably receive therein the first balance beam extension and the second extension receiver is adapted to removably receive therein the second balance beam extension.

5. The caregiver's helper lift assembly of claim 2 wherein the first extension receiver is adapted to removably receive therein the first balance beam extension and the second extension receiver is adapted to removably receive therein the second balance beam extension.

6. The caregiver's helper lift assembly of claim 3 wherein the first extension receiver is adapted to removably receive therein the first balance beam extension and the second extension receiver is adapted to removably receive therein the second balance beam extension.

7. The caregiver's helper lift assembly of claim 4 wherein the horizontal cross member is indirectly attached to the first extension receiver and the second extension receiver is adapted to provide a platform upon which the power plant can be positioned.

8. The caregiver's helper lift assembly of claim 5 wherein the horizontal cross member is indirectly attached to the first extension receiver and the second extension receiver and is adapted to provide a platform upon which the power plant can be positioned.

9. The caregiver's helper lift assembly of claim 6 wherein the horizontal cross member is indirectly attached to the first extension receiver and the second extension receiver and is adapted to provide a platform upon which the power plant can be positioned.

10. The caregiver's helper lift assembly of claim 1 wherein the horizontal cross member is attached to the T bar and is adapted to provide a platform upon which the power plant can be positioned.

11. The caregiver's helper lift assembly of claim 3 wherein the horizontal cross member is attached to the T bar and is adapted to provide a platform upon which the power plant can be positioned.

12. The caregiver's helper lift assembly of claim 6 wherein the horizontal cross member is attached to the T bar and is adapted to provide a platform upon which the power plant can be positioned.

13. The caregiver's helper lift assembly of claim 10 wherein a cross brace is attached to the horizontal cross member and the T bar member and is adapted to provide a support to brace the horizontal cross member in position.

14. The caregiver's helper lift assembly of claim 11 wherein a cross brace is attached to the horizontal cross member and the T bar member and is adapted to provide a support to brace the horizontal cross member in position.

15. The caregiver's helper lift assembly of claim 12 wherein a cross brace is attached to the horizontal cross member and the T bar member and is adapted to provide a support to brace the horizontal cross member in position.

16. The caregiver's helper lift assembly of claim 1 wherein the first balance beam extension is removably locked to the brace base by a first beam extension lock and the second balance beam extension is removably locked to the brace base by a second beam extension lock.

17. The caregiver's helper lift assembly of claim 4 wherein the first balance beam extension is removably locked to the brace base by a first beam extension lock and the second balance beam extension is removably locked to the brace base by a second beam extension lock.

18. The caregiver's helper lift assembly of claim 7 wherein the first balance beam extension is removably locked to the brace base by a first beam extension lock and the second balance beam extension is removably locked to the brace base by a second beam extension lock.

19. The caregiver's helper lift assembly of claim 10 wherein the first balance beam extension is removably locked to the brace base by a first beam extension lock and the second balance beam extension is removably locked to the brace base by a second beam extension lock.

20. The caregiver's helper lift assembly of claim 13 wherein the first balance beam extension is removably locked to the brace base by a first beam extension lock and the second balance beam extension is removably locked to the brace base by a second beam extension lock.

* * * * *